United States Patent [19]

Langanke et al.

[11] 4,098,097

[45] Jul. 4, 1978

[54] FABRICS MADE FROM AS SPUN UNTWISTED YARN

[75] Inventors: Helmut Langanke, Offenbach; Roman Hoffmeister, Wehrheim; Herbert Fritz, Niederdorfelden, all of Germany

[73] Assignee: Metallgesellschaft Aktiengesellschaft, Frankfurt am Main, Germany

[21] Appl. No.: 790,369

[22] Filed: Apr. 25, 1977

[30] Foreign Application Priority Data

May 28, 1976 [DE] Fed. Rep. of Germany ..... 2623904

[51] Int. Cl.[2] ..... D04B 1/00; D04B 21/00

[52] U.S. Cl. ..... 66/202; 66/195; 57/140 R; 139/421

[58] Field of Search ..... 66/202, 169 R, 170, 66/171, 172 E, 195; 139/420 R, 421; 57/140 R, 140 J

[56] References Cited

U.S. PATENT DOCUMENTS

| | | | |
|---|---|---|---|
| 2,619,705 | 12/1952 | Foster | 139/420 R X |
| 2,904,952 | 9/1959 | Weiss et al. | 57/140 R X |
| 3,025,689 | 3/1962 | Beghelli | 66/202 |
| 3,305,911 | 2/1967 | Chapman et al. | 66/202 X |
| 3,323,190 | 6/1967 | Boltniew | 57/140 R X |
| 3,413,796 | 12/1968 | Comer et al. | 66/202 |
| 3,442,099 | 5/1969 | Auville et al. | 66/195 X |
| 3,530,904 | 9/1970 | Ballard | 139/429 |
| 3,797,221 | 3/1974 | Ikeda et al. | 57/140 R |
| 3,842,583 | 10/1974 | Gage | 57/140 R |
| 3,858,622 | 1/1975 | Campbell et al. | 139/421 |
| 3,861,133 | 1/1975 | Frankfort et al. | 57/140 R |
| 3,975,929 | 8/1976 | Fregeolle | 66/172 E |

FOREIGN PATENT DOCUMENTS

| | | | |
|---|---|---|---|
| 272,732 | 10/1963 | Australia | 66/202 |
| 2,310,124 | 9/1974 | Fed. Rep. of Germany | 66/195 |

OTHER PUBLICATIONS

Hall, E. D. et al., *Knits of Textured and Draw-Textured Dacron Polyester Yarn,* In Knitting Times, 43(12): pp. 73–76, Mar. 25, 1974.

*Primary Examiner*—Louis K. Rimrodt
*Assistant Examiner*—Andrew M. Falik
*Attorney, Agent, or Firm*—Burgess, Dinklage & Sprung

[57] ABSTRACT

A textile fabric made from synthetic multifilament yarn, particularly for use in articles of clothing, the yarn having an elongation at break of at least 45%. The yarn may comprise polyamides, polyesters or polyolefins and range in denier from 10 to 500 dtex, the individual filaments ranging from 1.5 to 20. The yarns are advantageously produced by high speed spinning and, though flat, i.e. untwisted and untextured, they can be knit or woven into fabrics from which comfortable garments can be made.

6 Claims, No Drawings

FABRICS MADE FROM AS SPUN UNTWISTED YARN

This invention relates to a textile fabric which is made from synthetic multifilament yarn and is particularly intended for use in articles of clothing.

Modern fabrics for use in articles of clothing often consist entirely or in part of synthetic yarn. Polyamides, polyesters or polypropylene are mainly used as synthetic material. For many fields of application, synthetic yarn used in articles of clothing is textured and as it is textured is stretched to have an elongation at break of only 30% or less. In known textile fabrics made from polyamide yarn, the latter has an elongation at break of 25 to 35%. For this reason it was believed that it is not possible to use a yarn having a higher elongation at break in the manufacture of a textile fabric which can be comfortably worn.

Surprisingly it has now been found that synthetic yarn having an elongation at break of at least 45% can be used in textile fabrics to be used in articles of clothing. The yarn used for making such textile fabrics is preferably non-textured when it is incorporated in the fabric.

The yarn is usually wound on a bobbin when it has been spun and can be incorporated in the desired textile fabric directly by being knit or woven without need for a further stretching of the yarn. The resulting textile fabric has a somewhat higher extensibility than known synthetic fabrics and may be used, e.g., in articles of men's or ladies' clothing, particularly in ladies' outerwear or underwear. It can be worn substantially as comfortably as the known fabrics, and slight changes in the physical properties of the yarn are more than offset by the considerable reduction in the cost of manufacturing the yarn. Above all, the novel textile fabric has a pleasant textile handle.

The yarn used in the textile fabric may be made by known processes. Suitable spinning processes have been described, e.g., in Printed German Application No. 2,207,849 in Opened German Specification No. 2,347,801, and in U.S. Pat. Nos. 3,880,371 and 3,837,156. In these processes, monofilaments are extruded through a spinneret, cooled by an air blast, bundled by filament guides, coated with an antistatic agent, and pulled off an wound up by a high-speed winder. The winding speed at which the filaments are pulled off and stretched at the same time is in the range of 3000 to 6000 meters per minute.

The spinning process may be performed with or without godets. Spinning without godets is preferred because the equipment is less costly. The monofilaments of the yarn product are of 1.5 to 20, preferably 2 to 8, dtex and the yarn is usually in the range from 10 to 500 dtex.

If the novel textile fabric consists of polyamide yarn, the latter is preferably made to have an elongation at break of 45 to 100%. The elongation at break is determined in accordance with DIN 53815 and is equal of the quotient $$(\Delta\, 1/1_o) \times 100\%$$

where $1_o$ is the length of the non-elongated yarn and $\Delta 1 = 1_{max} - 1_o$, $1_{max}$ being the length of the yarn under the ultimate load before breaking.

When the textile fabric is made from polyester yarn, the latter is made to have an elongation at break of 50 to 150%, preferably 80 to 100%. It was previously believed that the elongation of polypropylene yarn incorporated in textile fabric must not exceed about 30 or 40%. It has now been found that the elongation at break may be in the range of 100 to 220% if a textile material for specific articles of clothing is to be made.

The novel textile fabric made from synthetic yarn having a relatively high elongation at break has a force-elongation behavior in the range which is required for a good textile performance. The fabric can be made without difficulty, e.g., on warp knitting machines, circular knitting machines or raschel knitting machines. From the bobbin on which the as-spun yarn has been wound, the yarn is usually supplied to these machines directly without an intermediate operation, such as twisting, plying, texturing, or rewinding, i.e. flat. It will be readily apparent that this enables considerable savings in cost.

The invention will be further described in the following illustrative examples.

EXAMPLE 1

Granules of polyamide-6 having a relative viscosity of 2.7, in a measurement taken at 25° C, using a solution of 1 gram of granules dissolved in 100 $cm^3$ concentrated sulfuric acid, are melted at 270° C and extruded through a spinneret having 13 orifices 0.2 mm in diameter. The resulting filaments travel through a cooling duct and are coated with a commercial antistatic agent and then combined in a yarn and wound up at a speed of 3500 meters per minutes and without contacting interposed godets. The antistatic agent consists of an oil-water emulsion and increases the filament weight by 0.8%.

The yarn is of 44/13 dtex, a strength of 4.7 grams per dtex and an elongation at break of 68%. The denier varies by about 0.8%. This yarn is supplied to a conventional direct warping machine for making 16 warp beam sections, each of which comprises 670 ends. The warp beam sections are supplied to a warp knitting machine having 32 needles per inch. Two guide bars are used for the desired interlooping, and 5360 warp threads are supplied for each guide bar. The following interlooped pattern is selected: First guide bar: 2-3, 1-0; second guide bar: 1-0, 1-2.

The knitted fabric is dyed on the beam under the conditions which are usual for polyamide yarn and is then heat-set in the tenter frame. The resulting knitted fabric is used to make ladies' slips.

EXAMPLE 2

Granules of polyester having a relative viscosity of 1.62 in a measurement taken at 20° C, using a 1% solution of polyester granules in metacresol, are melted at 284° C and extruded through a spinneret having 34 orifices 0.2 mm in diameter. The resulting filaments travel through a cooling zone and are coated with a commercial antistatic agent, combined in a yarn and wound at a speed of 3500 meters per minute without contacting interposed godets. The antistatic coating increases the filament weight by 0.4%.

The yarn is of 170/34 dtex, a strength of 2.4 grams per dtex and an elongation at break of 120%. The denier varies by about 0.7%. This yarn is supplied from 20 warp beam sections having 420 ends each to a conventional raschel knitting machine having 40 needles per 2 inches. Four guide bars are used for the desired interlooping and 2100 warp threads are supplied to each guide bar. The following interlooped pattern is selected: First guide bar for fringes, second and third guide bars for filling and fourth guide bar for tricot. The resulting textile fabric is used to make ladies' outerwear.

EXAMPLE 3

Granules of polypropylene having a melt index MFI of 14 grams per 10 minutes at 230° C/2.16 kg are melted at 280° C and extruded through a spinneret having 34 orifices 0.3 mm in diameter. The resulting filaments travel through a cooling duct and are coated with a commercial antistatic agent and then combined in a yarn and wound up at a speed of 3500 meters per minute without contacting interposed godets. The antistatic coating increases the filament weight by 0.8%.

The yarn is of 76/25 dtex, a strength of 2.8 grams per dtex, a denier variation of less than 1% and an elongation at break of 160%. This yarn is processed in a warp knitting machine having 28 needles per inch and supplied with 12 warp beam sections having 600 ends each. Two guide bars are used to obtain the desired interlooping and 3600 warp yarns are supplied for each guide bar. The following interlooped pattern is selected: First guide bar: 1-0-1, 1-2-1; second guide bar: 2-3-2, 1-0-1.

It will be appreciated that the instant specification and examples are set forth by way of illustration and not limitation, and that various modifications and changes may be made without departing from the spirit and scope of the present invention.

What is claimed:

1. A warp knit fabric characterized by a pleasant hand of close construction for use in articles of clothing made directly from high speed as spun synthetic multifilament yarn of less than 170 d/tex and about 2 to 8 d/tex per filament of a material selected from the group consisting of polyamide, polyester and polypropylene, said yarn being in a nontextured and untwisted state and having an elongation at break of at least 45% and a tenacity corresponding to that of a conventional drawn yarn.

2. A textile fabric according to claim 1, wherein the yarn is of polyamide and has an elongation at break of 45 to 100%.

3. A textile fabric according to claim 2, wherein the yarn has an elongation at break of 60 to 80%.

4. A textile fabric according to claim 1, wherein the yarn is polyester and has an elongation at break of 50 to 150%.

5. A textile fabric according to claim 4, wherein the yarn has an elongation at break of 80 to 100%.

6. A textile fabric according to claim 1, wherein the yarn is polypropylene and has an elongation at break of 100 to 220%.

* * * * *